US005078840A

United States Patent [19]

Ogawa et al.

[11] Patent Number: 5,078,840

[45] Date of Patent: Jan. 7, 1992

[54] PROCESS FOR THE SURFACE TREATMENT OF CARBON FIBER STRANDS

[75] Inventors: Hiroyasu Ogawa; Tetsuro Shigei; Tomoki Koseki, all of Shizuoka, Japan

[73] Assignee: Toho Rayon Co., Ltd., Tokyo, Japan

[21] Appl. No.: 554,997

[22] Filed: Jul. 20, 1990

[30] Foreign Application Priority Data

Jul. 20, 1989 [JP] Japan ..... 1-188573
Aug. 11, 1989 [JP] Japan ..... 1-208576

[51] Int. Cl.[5] ..... C01D 7/34
[52] U.S. Cl. ..... 204/130; 204/132
[58] Field of Search ..... 204/130, 132

[56] References Cited

U.S. PATENT DOCUMENTS 3,896,010 7/1975 Vetter ..... 204/28
4,234,398 11/1980 Yamamoto ..... 204/130

*Primary Examiner*—John Niebling
*Assistant Examiner*—Arun S. Phasge
*Attorney, Agent, or Firm*—Sughrue, Mion, Zinn, Macpeak & Seas

[57] ABSTRACT

A process for electrolytically treating the surface of a carbon fiber without using a surface treatment bath, comprising forming a flow of an electrolyte solution in the form of a liquid film or column at at least one anode and at at least one cathode which alternate along the direction of the length of the carbon fiber, and passing carbon fiber strands through the flows of the electrolyte solution to apply electric current to the carbon fiber strands.

11 Claims, 6 Drawing Sheets

FIG. 1a
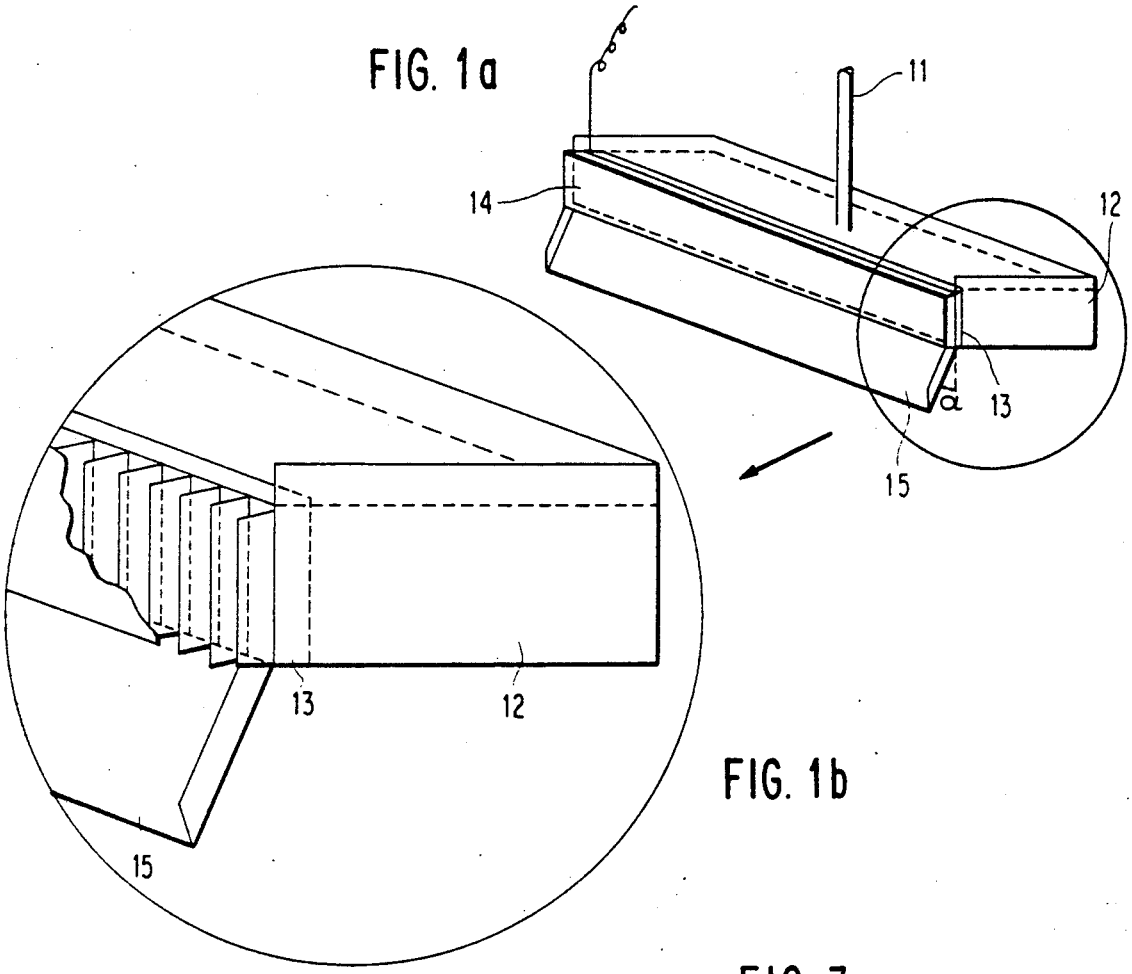
FIG. 1b
FIG. 3
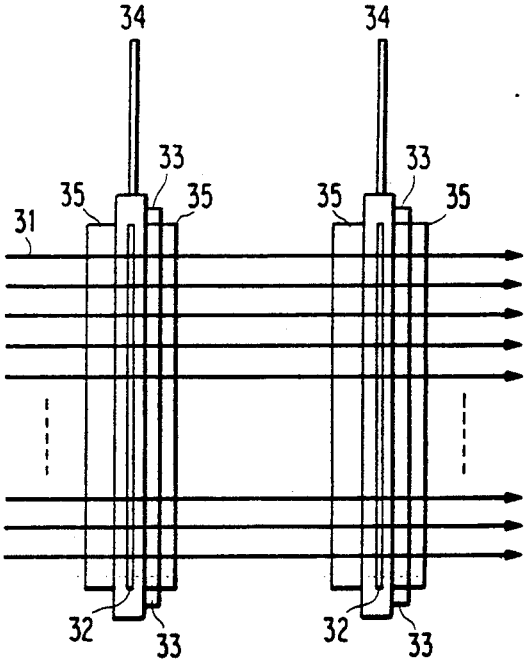
FIG. 2
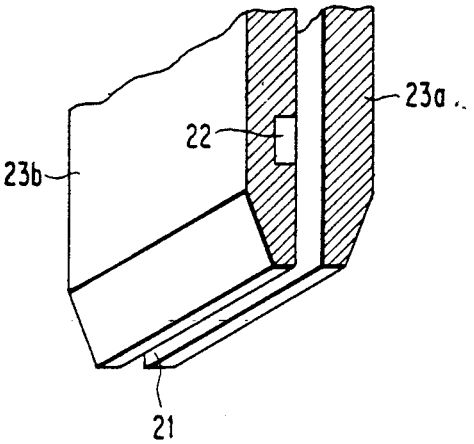

PROCESS FOR THE SURFACE TREATMENT OF CARBON FIBER STRANDS

FIELD OF THE INVENTION

The present invention relates to a process for electrolytically treating the surface of carbon fiber (in the present invention carbon fiber means carbon fiber and graphite fiber). The present invention enables effective treatment of a plurality of carbon fiber strands uniformly with respect to the length direction and between the fiber strands. The carbon fiber strands produced by the surface treatment according to the present invention are excellent in adhesiveness to resins, and are useful as a superior reinforcing material.

BACKGROUND OF THE INVENTION

Generally, carbon fibers, which are light in weight and have high strength and a high modulus of elasticity, are in wide use due to their characteristics as a reinforcing material for plastic materials in various application fields such as structural materials for in the aerospace industry, in industrial machines, and in sport and recreational devices. Recently, in particular, high performance carbon fiber having a tensile strength exceeding 600 kgf/mm$^2$ has been commercialized as a primary structural material for aircraft.

Such high performance carbon fibers are required to have uniform quality in addition to good performance. The carbon fibers used in the aforementioned applications need to be surface treated so as to have an appropriate degree of adhesiveness to a matrix resin. Without the surface treatment, the adhesiveness to the resin would be insufficient, which causes a significant deterioration in the properties of the composite material prepared therefrom due to separation of the fiber from the resin. On the contrary, with excessive surface treatment, the performance of the composite material will frequently be lowered even though adhesiveness to the resin is improved.

Generally, conventional surface treatment processes include oxidation of the surface of the carbon fibers such as a gas phase oxidation treatment with nitrogen dioxide or the like; a liquid phase oxidation treatment with an oxidizing agent such as a perchlorate salt; and electrolytic oxidation treatment using the carbon fiber as an anode.

The electrolytic oxidation treatment using carbon fiber as the anode is industrially advantageous, since high temperature is not necessary in comparison with the gas phase oxidation treatment and a long treatment time is not necessary in comparison with the liquid phase oxidation treatment. This process is disclosed, for example in JP-B-47-40119 (the term "JP-B" as used herein means an "examined Japanese patent publication"), U.S. Pat. No. 3,671,411, etc.

Furthermore, for uniform treatment of the surface of the fiber, there are known processes for applying a uniform current density by selecting the position and the shape of the electrode in an electrolytic bath (JP-A-54-138625, etc.), (the term "JP-A" as used herein means an "unexamined published Japanese patent application"), and a process for treating the surface by bringing the fiber sequentially into contact with an anode (a roller) and a cathode (an electrolyte solution) (JP-B-48-12444). (The term "JP-B"

In using an electrolytic bath for surface treatment, a method has been reported where ultrasonic vibration is applied to the electrolyte solution for the purpose of uniformly treating the fiber even in the interior of the fiber bundle (JP-A-62-149970).

Further, for achieving higher performance, certain specific surface treating conditions, particularly, the surface treating energy, should be employed for improving performance as a composite material such as described in JP-A-55-12834.

Other electrolytic surface treatment methods are described, for example, in U.S. Pat. Nos. 3,214,647, 3,759,805, 3,657,082, 3,859,187, 3,671,411, 4,401,533, British Patent 1,326,736, 1,371,621 and 2,018,827A.

During the electrolytic surface treatment, the damage of carbon fiber strands and the formation of fluff should be prevented. For these purposes, there is known a method of flowing an electric current through the carbon fiber using an electrolyte solution without contact with an electrode roller or a guide (JP-B-47-29942) and a method employing an electrolyte solution overflowing from an anode solution bath and a cathode solution bath a portion of the solution extending above the container of the solution due to the surface tension of the solution.

For the effective industrial surface treatment of carbon fiber, the apparatus therefor is necessarily large and complicated in order to treat a large number of strands uniformly at one time without quality impairment such as fluff generation. In any of the above methods, surface treatment baths are employed, which result in bubbles of air, hydrogen or the like attaching to the surface of the carbon fiber while a fiber strand is passing through the bath, which tends to cause variations in the surface treatment, and which also requires any circulating solution which is used to be increased in quantity. To achieve higher productivity, variations in the surface treatment achieved in the breadth direction are liable to be caused as a result of the scale-up of the apparatus, and variations in the length direction are liable to be caused by an increased treating bath length. No method has been found for solving such problems. The present invention intends to solve the above-mentioned problems.

SUMMARY OF THE INVENTION

The first object of the present invention is to effectively remove bubbles which are generated and attached to the carbon fiber surface during electrolytic treatment, and to decrease variations in the degree of surface treatment with respect to the carbon fiber strand length direction and among the carbon fiber strands in the rapid surface treatment of a plurality of carbon fiber strands by applying an electric current thereto through an electrolyte solution.

The second object of the present invention is to effectively eliminate fluff, which results in the surface treating process, and to eliminate bridging between fiber carbon strands which causes variations in the degree of the surface treatment, to thereby decrease the non-uniformity of the treatment with respect to the carbon fiber strand length direction and among the fiber strands.

The third object of the present invention is to provide a process in which the quantity of the electrolyte solution can be reduced and which does not require a surface treatment bath.

The present invention provides a process for electrolytically treating the surface of a carbon fiber, which process comprises forming a flow of an electrolyte solution in the form of a liquid film or column at at least one anode and at at least one cathode placed alternately in the direction of the length of the carbon fiber strands and passing carbon fiber strands through the flow of the electrolyte solution to apply an electric current thereto.

BRIEF DESCRIPTION OF THE DRAWINGS

FIG. 1-*a* is a perspective view of a bathtub type electrode for overflowing an electrolyte solution for forming a flow of the solution. FIG. 1-*b* is an enlarged perspect view of a part of the bathtub with deletion of a part of the cover.

FIG. 2 is a perspective view of a slit shaped nozzle type electrode for ejecting an electrolyte solution.

FIG. 3 illustrates the arrangement of the slit shaped nozzle type electrodes in relation to the running direction of carbon fiber strands FIGS. 4-*a* and 4-*b* each shows the ejection direction of the electrolyte solution with respect to the direction of the carbon fiber strands.

FIG. 5-1 to FIG. 5-16 each shows the positions of electrodes and the ejection direction of the electrolyte solution with respect to the running direction of the carbon fiber strands.

FIGS. 6-*a* and 6-*b* each show the running direction of the carbon fiber strands.

FIG. 7 is a schematic view of the apparatus employed in Example 1.

FIG. 8 is a schematic view of the apparatus employed in Example 2.

FIG. 9 is a schematic view of the apparatus employed in Comparative Example 1.

FIG. 10 is a schematic view of the apparatus employed in Example 15.

FIG. 11 is a schematic view of the apparatus employed in Example 22.

DETAILED DESCRIPTION OF THE INVENTION

Figure 4A:
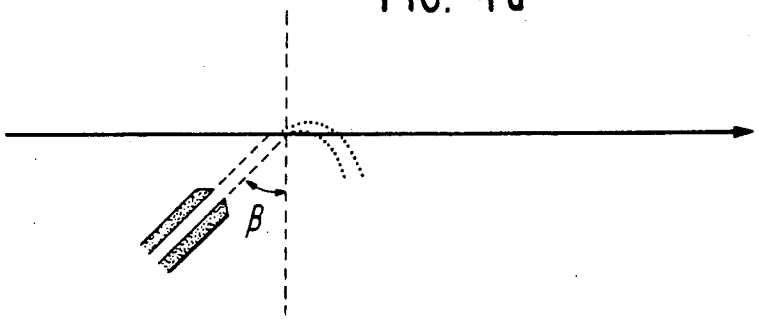
Figure 4B:
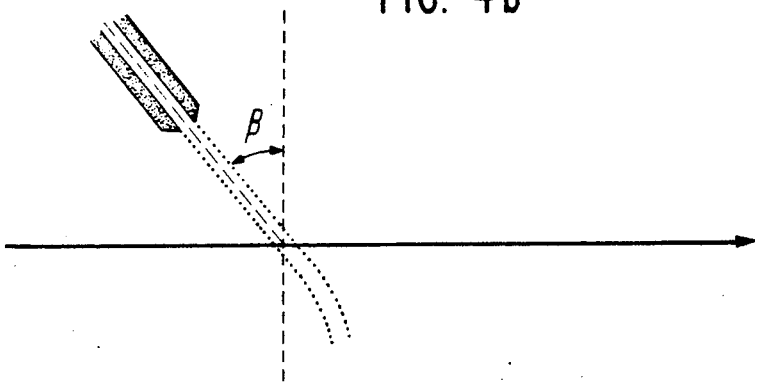
Figure 6A:
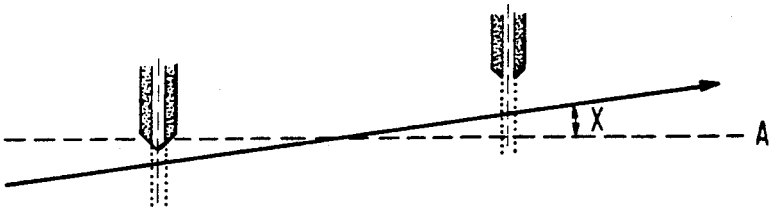
Figure 6B:
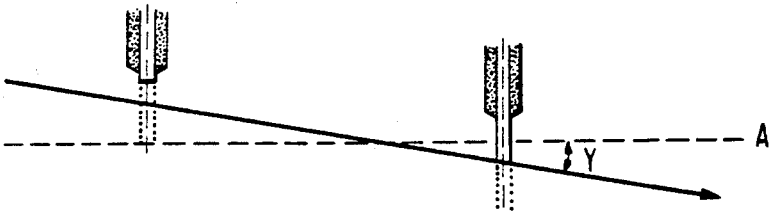

The present invention permits the electrolytic surface treatment of carbon fibers within a short processing length (rapid processing) with high efficiency and high uniformity.

The carbon fiber strand in the present invention is a bundle constituted of filaments of carbon fiber which are formed from, for example, polyacrylonitrile fiber, pitch fiber or rayon fiber, or graphite fiber filaments which may be produced according to any conventional method. For example, carbon fiber is produced by subjecting acrylic fiber, pitch fiber or rayon fiber to thermal stabilizing (or oxidizing) in an oxidizing atmosphere (in the case of acrylic fiber it is preferred to oxidize at 200° to 300° C.) and then subjecting the thus obtained fiber to a carbonizing treatment at a temperature of 800° C. or higher in an inert atmosphere, or further subjecting the carbon fiber to a graphitizing treatment at a temperature of 2,000° C. or higher. Methods for producing carbon fiber and graphite fiber are disclosed in, for example, U.S. Pat. Nos. 4,197,279, 4,397,831, 4,347,279, 4,474,906, and 4,582,801, incorporated by reference.

Carbon fiber filaments usually have a mean diameter of about 3–10 μm. A carbon fiber strand which is subjected to the electrolytic treatment of the present invention is generally composed of about 100 to 24,000 filaments.

Carbon fiber which is subjected to the electrolytic treatment of the present invention preferably does not have applied thereto a water insoluble sizing agent. The carbon fiber may have applied thereto a surfactant in order to permit the electrolyte solution to be uniformly and easily applied. Surfactants which are not electroconductive, which do not ionize and which do not react with carbon fiber upon electrolysis are preferably used. Nonionic surfactants such as polysiloxane, are preferably used in the present invention. The amount of the surfactant is usually from about 0.01 to 1% by weight.

The carbon fiber strands which are passed through the electrolyte solution are usually arranged parallel to each other. The distance between carbon fiber strands (in the direction perpendicular to the running direction of the carbon fiber strands) is such that the carbon fiber strands can avoid becoming entangled with each other. The distance is preferably at least 3 mm.

A proper tension is applied to the carbon fiber strands so that the amount of the electrolyte solution impregnated into the carbon fiber strands (hereafter this term or similar terminology also includes the amount of the solution adhered to the surface of the carbon fiber strands is sufficient to effectively carry out electroytic treatment. The tension should also be such that the carbon fiber strand does not become loose and also such that breaking of filaments due to the stretching is prevented. The tension applied to the carbon fiber filaments is usually from 0.04 to 0.5 g per filament, preferably from 0.06 to 0.3 g per filament.

The amount of the solution impregnated into the carbon fiber strands is difficult to measure. However, when the impregnated amount at the completion of the electrolytic treatment satisfies the following equation excellent results can be obtained. It is believed that the impregnated amount during the electrolytic treatment is substantially the same as the amount at the completion of the electrolytic treatment.

$$\frac{\text{weight of electrolyte solution}}{\text{weight of carbon fiber strand}} \times 100 = \text{at least } 40\% \text{ by weight}$$

Usually the amount is applied up to about 150% by weight.

The electrolyte solution used in the present invention may be a liquid which contains no electrolyte if the liquid itself has a specific electrical resistance of not higher than 3 MΩ·cm. Usually, however, the solution contains an electrolyte. The kind of the electrolyte is not especially limited if it functions as an electrolyte.

Particularly preferable electrolytes include inorganic acids such as sulfuric acid, nitric acid, phosphoric acid, boric acid, carbonic acid, and the like; organic acids such as acetic acid, butyric acid, oxalic acid, maleic acid, and the like; salts thereof such as alkali metal salts, ammonium salts, and the like; and mixtures thereof, such as a mixture of sodium hydroxide and sodium carbonate, a mixture of sodium sulfate and ammonium sulfate, and a mixture of sulfuric acid and sodium sulfate.

The concentration of the electrolyte in an aqueous solution depends on the transference number of the ions in the electrolyte solution and may be within the usually employed range of from 0.1 to 20% by weight (based on the weight of the solution), and preferably from 1 to 10% by weight. A surfactant may be added to the electrolyte solution, if desired.

Water or an electrolyte solution may be applied to the carbon fiber strands to be treated prior to the electrolytic treatment. The methods for applying water or the solution include bath immersion, spraying, roller transfer, and the like. The water or electrolyte solution content in the strand from this pretreatment is preferably from about 40 to 150% by weight based on the weight of the carbon fiber strand.

To employ the electrolyte solution as an anode or a cathode, a conductor which can apply an electric current to the solution is placed in the flow path of the electrolyte solution. If the mass of carbon fiber strands running in parallel is wide in the breadth direction (the direction perpendicular to the running direction), electrode terminal portions are desirably arranged so that there is at least one electrode terminal portion every 50 cm, i.e., one every 50 cm along the breadth direction in the direction perpendicular to the running direction of the carbon fiber strands, in order to achieve a uniform electric current density.

For forming a flow of the electrolytic solution in a liquid film state or a liquid column state, there may be used, for example, a conduit or a slit-shaped nozzle.

The method for forming the flow of the electrolyte solution is not specially limited, and useful methods include overflowing the solution from a bath provided with a conductor therein (to apply an electric current to the flow of the electrolyte solution), flowing the solution down along a conduit, and ejecting the solution downward or upward from a slit-shaped nozzle. In any method, it is necessary to flow the electrolyte solution in the state of a flowing liquid film or liquid column to allow the solution to come into uniform contact (over the breadth direction) with the carbon fiber strands, which is a basic requirement of the present invention.

In the method of overflowing an electrolyte solution from a bath containing the conductor, the conductor is desirably placed parallel to the edge of the bath in order to permit to permit the electric current (which is dependent on the electric resistance of the electrolyte solution) to flow uniformly from the electrolyte solution to the carbon fiber strands.

A conduit is preferably provided to allow the liquid overflowing from the edge of the bath to flow down in a liquid film state or a liquid column state. More preferably, the conduit has spacers placed in parallel to the direction of the flow of the solution. The conduit preferably has a length, in the direction of the flow, of from 10 to 50 mm. At a higher flow rate, since the rate of down flow of the liquid varies depending on the overflowing position, the use of a flow straightening vane is effective to obtain a uniform flow rate and a uniform surface treatment of the carbon fiber. The flow straightening vane is preferably placed at an angle with respect to the running direction of the carbon fiber 'strands,' namely, at an angle ($\alpha$) of from 30° to 0° with respect to vertical line as shown in FIG. 1-*a*.

Figures 1, 5:
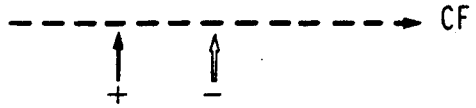

FIG. 1-*a* illustrates a device employed as a bathtub type electrode, where the numeral 11 denotes an inlet for the electrolyte solution; 12, a bathtub; 13, an electrode provided in the bath; 14, a conduit for forming a liquid film or a liquid column; and 15, a flow straightening vane displaced by angle from the vertical. The arrow shows the running direction of the carbon fiber strands which run under the device. FIG. 1-*b* illustrates a example of the structure of a conduit having spacers.

In ejecting the electrolyte solution downward or upward, the conductor is preferably provided inside the nozzle. The conductor is preferably divided so as to provide a uniform electric current density in the breadth direction of the carbon fiber strands. Alternatively, the conductor is preferably in such a shape that a plurality of electrode terminals are provided. When the conductor is placed inside the nozzle, the conductor cannot have a large sectional area. Therefore, when only one electrode terminal is used, the electric current density in the breadth direction tends to depend on the specific resistance of the conductor material. To obtain a small variation in the treatment among the carbon fiber strands, the electric current density has to be made uniform. When the specific resistance of the conductor is $10^{-4}$ Ω·cm. or more, it is preferred that at least one terminal be provided in the breadth direction every 50 cm. Particularly, when carbon is used as the conductor, a larger number of terminals is remarkably effective to attain a uniform surface treatment.

Slit shaped nozzles advantageously have a slit opening of from 0.05 to 5 mm, preferably from 0.1 to 3 mm (along the running direction of the carbon fiber strands), and have a length (in the direction perpendicular to the running direction of the carbon fiber strands) corresponding to the breadth of the plurality of running carbon fiber strands. With an opening exceeding 5 mm, a large quantity of the electrolyte solution is required to eject the electrolyte solution into contact with the carbon fiber, which is not advantageous on a commercial scale. With an opening below 0.05 mm, the quantity of the electrolyte attached to the carbon fiber strands will become lower, thereby causing non-uniformity of the treatment in the length direction of the carbon fiber strands. At too high an ejection velocity for increasing the amount of attached and impregnated quantity of liquid, the amount of fluffs tends to increase, which deteriorates the quality of the products and ma clog the nozzle due to particulate impurities, rendering long term operation impractical.

Figures 2, 5:
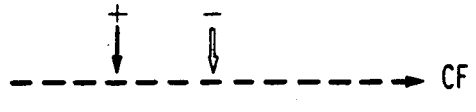

FIG. 2 is a perspective view of a typical slit shaped nozzle useful in the present invention. In FIG. 2, the numeral 21 denotes a slit for ejecting an electrolyte solution, 22, a conductor for applying an electric current, and 23*a* and 23*b*, two body parts of the nozzle. The conductor is preferably positioned in the vicinity or at the edge of the ejecting outlet of the slit 21. This is because a high voltage is required if the electroconductivity of the electrolyte solution is low.

The construction material for the nozzle may be selected from those resistant to corrosion by the electrolyte solution, such as polyvinyl chloride resins, polypropylene resins, acrylic resins, and the like. Stainless steel, titanium, and the like coated with a resin as above exemplified or other resins may also be used. The slit shaped nozzle itself may be used as the electrode, provided that it is made of a material, such as platinum, which is noncorrosive under the electrolytic treatment conditions.

The nozzle can be placed above or below the running fiber bundle carbon fiber strands.

The solution is ejected through the slit shaped nozzle in the state of a liquid film (or an electrolyte curtain) or in the state of a liquid column both of have a uniform thickness in the breadth direction.

Figures 3, 5:
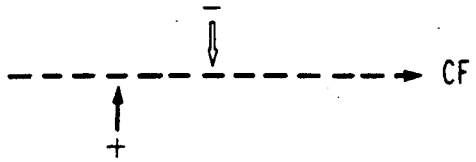

The arrangement of the slit shaped nozzles in relation to the running direction of the carbon fiber strands is shown in plane view in FIG. 3, where numeral 31 denotes the carbon fiber strands; 32, the slit shaped nozzles which eject the electrolyte solution; 33, the electrode terminals; 34, the inlets for the electrolyte solution; and 35, receiving pans for ejected solution.

The ejection velocity of the electrolyte solution from the nozzle is controlled so that generation of fluffs from the carbon fiber strands can be avoided. Usually it is in the range of from 50 to 500 cm/sec. In the case of upward ejection it is preferably from 70 to 200 cm/sec, and, in the case of downward ejection, from 55 to 150 cm/sec,. At an ejection velocity of the electrolyte solution onto and into the carbon fiber strands within this range, the generation of fluffs is low, and bubbles of hydrogen or the like formed on the surface of the carbon fiber can be effectively eliminated, which is a problem to be solved. Additionally, fluffs which are initially present on the carbon fiber strands and which are brought to the surface treating process can be washed off, which contributes to improve the quality of the product.

At an ejection velocity of less than 50 cm/sec, the solution cannot easily be kept in a liquid film state, and there results a non-uniform quantity of liquid attached to the carbon fiber strands. At an ejection velocity exceeding 500 cm/sec, generally, the impact force against the carbon fiber strands is excessively great, causing a remarkable increase of fluffs. The impact force may be reduced by inclining the direction of the flow so that the flow has a vector component having the same direction as the running direction of the carbon fiber strands. However, it may also be a vector component having a direction reverse to the running direction of the carbon fiber strands. The rate of flow upon contacting with the carbon fiber strand is preferably at least 20 cm/sec and not more than 500 cm/sec, more preferably at least 30 cm/sec and not more than 200 cm/sec, and most preferably at least 50 cm/sec and not more than 80 cm/sec.

In either of the overflow type or the slit shaped nozzle type, the distance between the carbon fiber strands and the tip of the conduit or the distance between the carbon fiber strands and the nozzle outlet is not especially limited, provided that the carbon fiber strands can run through the liquid film or the liquid column of the electrolyte solution. However, if the distance is extremely small, the carbon fiber strands may vibrate due to the ejection and be brought into contact with the tip of the conduit or the nozzle, which is not preferred in view of product quality, such as fluff generation. Accordingly, the distance is preferably not less than 3 mm, preferably not less than 5 mm and not more than 20 mm.

As can be seen in FIG. 3, the direction of the opening (in the length direction) of the nozzle or the edge of conduit for the electrolyte solution is preferably substantially perpendicular to the running direction of the plurality of parallel carbon fiber strands. Use of an oblique placement makes the process line disadvantageously longer.

The electrolyte solution flow is required to be in the state of a liquid film (or a water curtain) or a liquid column having a uniform thickness over the breadth direction of the running carbon fiber strands.

The thickness of the electrolyte solution where the carbon fiber strands pass therethrough is preferably from about 0.025 to 5 mm, more preferably from about 0.05 to 3 mm.

The distance between the anode and the cathode (electrode spacing) placed perpendicularly to the running direction of the plurality of parallel carbon fiber strands will greatly affect the degree of the surface treatment. In the case where an electrolyte solution bath is used, usually the residence time of the carbon fiber strands bundles in the bath at the cathode side is normally made to be ten times or more the contact time at the anode side. In the present invention, the electrolytic treatment is substantially conducted at a site where the voltage is higher than the water decomposition voltage between the anode and the cathode. At a site where the voltage is lower than the water decomposition voltage, the treatment proceeds extremely slow or only to a slight extent. With a larger electrode spacing, the electrical resistance between the electrodes will become high, and bubbles will be formed on the surface of the carbon fiber strands between the electrodes, so that the electrode spacing is preferably not more than 500 mm and not less than 5 mm.

In a modification, more than three electrodes may alternately be provided in the running direction of the carbon fiber strands, which enables a more uniform treatment and a shortening of the treatment time. In this case, the apparatus need not to be overly long in the running direction of the carbon fiber strands, but a plurality of the electrodes may be placed within a desired length. Usually, two or more pairs (anodes plus cathodes), preferably 4 to 12 pairs, of electrodes are used, and either one anode or one cathode may further be added to these pairs. At an electrode spacing of less than 5 mm, the flow of the solution for each of the electrodes will result in be short circuiting before the solution reaches the carbon fiber strands, which makes it non-feasible to use separate flows of the solution for respective electrodes. At a larger electrode spacing, the electrical resistance between the electrodes becomes higher, which requires a higher treatment voltage and lengthens the process. Considering the above, the spacing between each electrode is preferably in the range of from 5 to 200 mm in the case where more than three electrodes are provided.

Figures 4, 5:
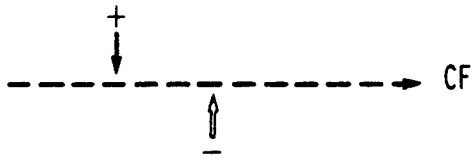
Figure 5:
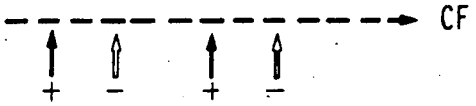

The direction of flow of the electrolyte solution may be upward or downward in a direction perpendicular with respect to the running direction of the carbon fiber strands, or it may be inclined from the perpendicular so that the impact force of the flow is reduced. It is usually inclined at an angle ($\beta$) of from 0°–60° from the perpendicular with respect to carbon fiber strands. The angle $\beta$ is shown in FIGS. 4-*a* and 4-*b*.

With respect to the arrangement of liquid electrodes, either the anode or cathode may be placed as the first electrode.

The directions of flow of the electrolyte solution to form a liquid anode and cathode may be the same with respect to each other or may be different from each other. Examples of combinations of directions of the flow are shown in FIG. 5-1 to FIG. 5-16. The travel direction of carbon fiber strands in FIGS. 5-1 to 5-16 is from left to right. In these combinations the running direction of the strands and/or the ejection direction of the electrolyte solution may be inclined as described hereinafter and hereinabove, respectively.

In FIG. 5-1 to FIG. 5-16, FIGS. 5-1, 5, 2, 5 and 6 are especially preferred with respect to the arrangement of the apparatus, the operation thereof and to prevent short circuiting. In the arrangement where the flow contacts the carbon fiber strands from the upper side, fluffs are especially effectively eliminated.

Figures 5, 6:
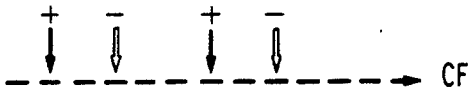

The running direction of the carbon fiber strands is usually horizontal, but it may also be inclined upwardly or downwardly as shown in FIG. 6. The angle ($\gamma$) of the running direction from the horizontal direction (shown by dotted line A) is usually from 0° to ±30°.

The carbon fiber strands preferably pass through the flow of electrolyte solution at a position where the flow is stable. In the present invention preferred electrolytic treatment conditions are as follows:

The electric current is preferably from about 0.5 to 4 Ampere/g, the terminal voltage is from about 5 to 15 volts (at the substantial electrodes it is from about 0.5 to 3 volt), and the temperature is from about to 40° C. (usually processing is conducted at room temperature, i.e., 20° to 25° C.).

The quantity of electricity applied to the carbon fiber strands is preferably about 10 to 150 coulomb/g, more preferably is about 15 to 100 coulomb/g. The surface treating usually can be conducted within the range of from 5 to 60 seconds. The travel rate of the carbon fiber strand is preferably from 1 to 6 m/min.

After the surface treating the carbon fiber strands are washed to remove the electrolyte and dried, usually at from 100° to 200° C., if desired.

The electrolyte solution, after being brought into contact with the carbon fiber strands, enters the receiving pan, and it may then be recovered and recycled. The distance between the carbon fiber strands and the receiving pan is desirably sufficiently large to prevent electric current leakage and short circuiting and to eliminate attached fluffs. This is preferable in view of general operability of the process.

If the flow comes too close or contacts the flow of a counter electrode, short circuiting should be prevented by providing a partition plate, or other means to keep the flows out of contact.

The present invention enables effective treatment of carbon fiber strands without using roller electrodes or a surface treating bath. This gives the potential advantages of considerably decreasing the amount of electrolyte solution used and shortening the treatment time in comparison with conventional surface treatments using a solution bath.

Further, if the treatment rate is fixed, and the electrode spacing is assumed to be the same as that required in a treatment process using an electrolyte solution bath, the same degree of surface treatment can practically be achieved at a half or less electrode spacing in the present invention, which is an important characteristic of the present invention. Additionally, use of more than three electrodes enables a shortening of the treatment time.

The present invention, which does not employ a roller or the like, makes it possible to reduce damage to the fibers such as the generation of fluffs.

In the present invention, fluffs from a previous step and generation of bubbles at the surface of the carbon fiber during electrolytic treatment can be effectively eliminated. Consequently, variations in surface treatment are reduced in the length direction of the carbon fiber strands and among the carbon fiber strands.

Carbon fiber strands treated according to the present invention have uniform and excellent adhesiveness with thermosetting resins, such as an epoxy resin, and thermoplastic resins.

The present invention is specifically explained referring to Examples which are not intended to limit the invention in any way.

The definitions of the terms and the methods of measurement used in the Examples are as follows.

a. Amount of Surface-Bonded Oxygen:

By the surface treatment functional groups containing an oxygen atom(s) are formed on the surface of the carbon fiber. Therefore, an increased amount of surface bonded oxygen can be attained by increasing the electricity quantity (coulomb/g) applied to the carbon fiber strands.

The amount of the surface bonded oxygen is represented by the ratio (O/C) of the number of the oxygen atoms present relative to one carbon atom derived from the peak area ratio of oxygen and carbon measured by an X-ray photoelectronic spectrometer (Electron Spectrometer for Chemical Analysis, e.g., ESCA, Model 750: made by Shimadzu Seisakusho, Ltd.). The amount of each element at a thickness of about 50 Åfrom the surface of a carbon fiber filament is determined using such a spectrometer. The bonded oxygen increases with the progress of the surface treatment. The O/C value can be increased up to 0.5.

In the Examples, this value was employed as a measure of any variation in the surface treatment in the length direction of the carbon fiber strands. The measurement was conducted by taking 20 samples per 10 meter of the carbon fiber strands, and the average and CV (coefficient of variation) % was calculated.

b. ILSS (Interlaminar shear strength):

Carbon fiber strands were immersed in 120° C.-cure type bisphenol A epoxy resin to prepare a sheet-like prepreg of 150 g/m$^2$. The fiber content was 60% of the total volume of the prepreg. 20 plies of this prepreg were laminated in the same direction with respect to the direction of the length of the carbon fiber strands and cured at 120° C. under 5 kg/cm$^2$ for 90 minutes to give a molded article. Test specimens were cut out (length (in the direction of the length of the carbon fiber strands)×width×thickness =20 mm×10 mm×3 mm), and were subjected to measurement (short beam, three-point bending test) according to ASTM-D2344.

For each sample, 5 test specimens (n=5) from one molded article were prepared, and the average value was calculated. Unless specially mentioned, the results are shown by the average values and CV% (among carbon fiber strands) for 10 (N=10) carbon fiber strands.

Furthermore in the following Examples, unless especially otherwise mentioned, the carbon fiber strands traveled horizontally and the electrolyte solution was ejected vertically thereonto.

EXAMPLE 1

A polyacrylonitrile carbon fiber strand (Besfight HT-12000 (trade name); made by Toho Rayon Co., Ltd.) composed of 12,000 filaments (tensile strength: 380 kgf/mm$^2$, tensile modulus of elasticity: 24×10$^3$ kgf/mm$^2$, diameter: 7 μm) which had not been subjected to any surface treatment was employed as the starting material. The ILSS for the carbon fiber strands was found to be 7.8 kgf/mm$^2$ (CV=2.7%), and the quantity of surface bonded oxygen was found to be 0.08, as the O/C value (CV=6%).

Figures 5, 6, 7:
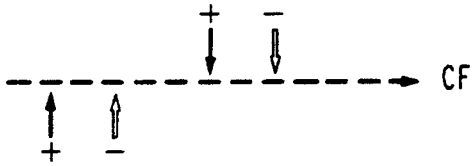

A schematic diagram of a bath over flow type apparatus employed for the treatment is shown in FIG. 7, where numeral 71 denotes a carbon fiber strand; 72, an anode bath having a conductor to apply electric current to an anode; 73, a cathode bath having a conductor to apply electric current to a cathode; 74, a receiving pan for the electrolyte solution; and 75, a conduit with a flow straightening vane (made of polyvinyl chloride). The angle α was 30° and the distance between a fiber strand 71 and the tip of the conduit 75 was 5 mm. The electrode was made of platinum.

100 carbon fiber strands were run parallel to each other at spacings of 5 mm between each strand, and were treated at a running speed of 2 m/min. An aqueous solution of 10% by weight of ammonium sulfate as the electrolyte solution was flowed down at a rate of 5 ml/cm/sec to form a liquid film from an anode bath 72 and from a cathode bath 73 with an electrode spacing of 400 mm, the flows being brought into contact (at a rate of 103 cm/sec) with the carbon fiber strands to conduct electrolytic surface treatment. The thickness of the film where the strands passed through the film was about 1 mm. The voltage between the electrodes was 13 volts and the electric current was 80 amperes. The quantity of electricity for the treatment was 30 coulomb/g of carbon fiber.

The thus treated carbon fiber strands were washed with water, dried at 110° C. for about one minute, and wound up on a bobbin.

The surface bonded oxygen was determined by ESCA to be 0.20 as the O/C value. The adhesiveness of the fiber to the resin was evaluated by ILSS to be 10.9 kgf/mm$^2$, with a variation of 1.0% (N=10) as CV.

EXAMPLE 2

The same carbon fiber strand as in Example 1 was employed as the starting material.

Figures 5, 6, 7, 8:
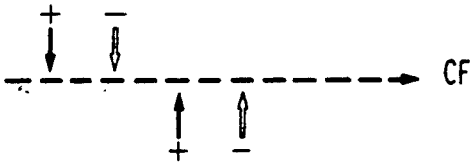

A schematic diagram of the apparatus employed for the treatment is shown in FIG. 8, where numeral 81 denotes a carbon fiber strand; 82, a slit shaped nozzle for the anode; 83, a slit shaped nozzle for the cathode; 84, receiving pans for the electrolyte solution; 85, inlets for the electrolyte solution; and 86, the electrolyte solution. The distance between the fiber strand and each nozzle was 5 mm, and the slit opening of each nozzle was 0.5 mm.

100 carbon fiber strands as discussed above were run parallel to each other at spacing of 5 mm between each strand, and were treated at a running speed of 2 m/min. An aqueous solution of 5% by weight of ammonium sulfate as the electrolyte was ejected at a flow of 60 m/min vertically downward from nozzle 82 having a conductor therein and from nozzle 83 having a conductor therein with the electrode spacing being 400 mm, the electrolyte solution thus being brought into contact with the carbon fiber strands (at a rate of 103 cm/sec) to conduct the electrolytic surface treatment. The voltage between the electrodes was 12 volts and the electric current was 80 amperes. The quantity of electricity for the treatment was 30 coulomb/g of carbon fiber.

The thus treated carbon fiber strands were washed with water, dried at 110° C., and wound up on a bobbin.

The surface bonded oxygen was determined by ESCA to be 0.22 as the O/C value. The adhesiveness of the fiber to the resin was evaluated by ILSS to be 11.2 kgf/mm$^2$, with a variation of 0.9% (N=10) as CV.

COMPARATIVE EXAMPLE 1

Figures 5, 6, 7, 8, 9:
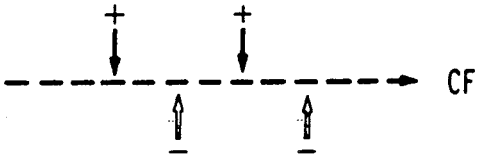

100 carbon fiber strands as employed in Example 1 as the starting material were subjected to electrolytic surface treatment by using a bathtub type surface treating bath (length of bathtub: 1 m) as shown in FIG. 9 with an aqueous 5% by weight of sodium sulfate solution as the electrolyte and at a treatment rate of 2 m/min. In FIG. 9, numeral 91 denotes a fiber strand; 92, an anode roller; 93, a cathode plate placed in electrolyte solution; and 94, the treating bath. The voltage between the electrodes was 12 volts and electric current was 81 amperes.

The quantity of electricity for the treatment was 30 coulomb/g of carbon fiber. The treated carbon fiber strand was washed with water, dried at 110° C., and wound up on a bobbin.

The surface bonded oxygen content determined by ESCA was 0.20, with a variation of 10.9% (n=20) in the length direction (measured every 50 cm). The ILSS was 10.9 kgf/mm$^2$ equivalent to that in Example 1, while the CV was as high as 3.5%.

EXAMPLES 3 TO 10

Electrolytic surface treatments were conducted in the same manner as in Example 2 except that the slit opening of the nozzles having conductors therein was changed. The results are shown in Table 1.

TABLE 1

| Example No. | Slit width (mm) | Ejection rate of electrolyte solution (l/min/m) | ILSS (CV %) (kgf/mm$^2$) |
|---|---|---|---|
| 3 | 0.025 | 0.75 | 10.5 (2.6) |
| 4 | 0.05 | 1.5 | 10.7 (2.2) |
| 5 | 0.10 | 3.0 | 10.8 (1.5) |
| 6 | 0.50 | 15.0 | 11.2 (1.1) |
| 7 | 1.00 | 30.0 | 11.0 (1.0) |
| 8 | 3.00 | 90.0 | 11.0 (1.4) |
| 9 | 5.00 | 150.0 | 11.2 (1.6) |
| 10 | 10.00 | 300.0 | 11.2 (1.8) |

From the results, the variation of ILSS is seen to be smaller at a slit opening in the range of from 0.10 mm to 10.00 mm.

EXAMPLES 11 TO 14

Electrolytic surface treatments were conducted in the same manner as in Example 2 except that the electrode spacing (namely the distance between the nozzles) was changed. Table 2 shows the results.

TABLE 2

| Example No. | Electrode spacing (mm) | Surface bonded oxygen (O/C) | ILSS (kgf/mm$^2$) | Treatment time (sec) |
|---|---|---|---|---|
| 11 | 100 | 0.14 | 9.5 | 6 |
| 12 | 150 | 0.18 | 10.5 | 9 |
| 13 | 300 | 0.20 | 11.0 | 18 |
| 14 | 500 | 0.21 | 11.2 | 30 |

From the results, it can be seen that in the present invention, the length of processing time can be reduced to half or less of that of Comparative Example 1 where the processing time was 30 seconds.

EXAMPLE 15

Figures 5, 6, 7, 8, 9, 10:
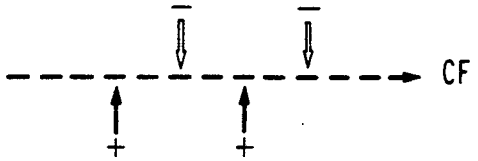

Onto the starting carbon fiber strands employed in Example 1, an aqueous 8% by weight ammonium sulfate solution was applied by a shower system. The amount of the solution impregnated into and onto a strand was 82% by weight based on the weight of the carbon fiber. Subsequently, 100 strands of this carbon fiber were subjected to a surface treatment using of an apparatus having three pairs of electrode nozzle as shown in FIG. 10 with an aqueous 8% by weight of ammonium sulfate solution as the electrolyte solution. In FIG. 10, numeral 101 denotes a carbon fiber strand; 102, slit-shaped nozzles for anodes; 103, slit shaped nozzles for cathodes; 104, inlets for the electrolyte solution; and 105, a receiving pan. The solution was ejected vertically downward at a flow rate of 60 m/min. The contacting rate of the solution to the carbon fiber strand was 103 cm/sec.

The voltage between electrodes was 12 volts and the electric current was 81 amperes.

In this apparatus, the distance between electrodes was 150 mm, and the slit opening was 0.5 mm. The quantity of electricity for the treatment was 30 coulomb/g of carbon fiber. The treated carbon fiber strands were washed with water, dried at 110° C., and wound up on a bobbin.

The surface bonded oxygen was determined by ESCA along the length direction of the carbon fiber strand (every 50 cm). The average of the measured values was 0.22, and the CV thereof in the length direction was 5.0%. The variation was less than that of Comparative Example 1. The measured ILSS value of the treated fiber strands was 11.2 kgf/mm$^2$, and the CV thereof was 0.7%, the variation being less than that of Comparative Example 1.

EXAMPLE 16

The surface treatment was conducted in the same manner as Example 15 except that four electrode terminals were provided (every 25 cm) for each of the conductors in the nozzles for anodes and cathodes.

The surface bonded oxygen was determined by ESCA along the length direction of the carbon fiber strands (every 50 cm). The average of the measured values was 0.23, and the CV variation thereof in the length direction was 4.1%. The variation was less than that of Comparative Example 1. The measured ILSS value of the treated fiber strands was 11.3 kgf/mm$^2$, and the CV thereof was 0.6%, this variation being less than that of Comparative Example 1.

EXAMPLES 17 TO 21

Surface treatment was conducted in the same manner as in Example 15 except that the distance between the nozzles for the anode and the nozzles was for the cathode was changed in the apparatus of Example 15. The results are shown in Table 3.

TABLE 3

| Example No. | Electrode spacing (mm) | Surface bonded oxygen (O/C) | CV (%) | ILSS (kgf/mm$^2$) | CV (%) |
|---|---|---|---|---|---|
| 17 | 5 | 0.15 | 8.0 | 9.6 | 2.0 |
| 18 | 50 | 0.19 | 6.0 | 10.2 | 1.2 |
| 19 | 100 | 0.19 | 4.8 | 11.0 | 0.8 |
| 20 | 200 | 0.22 | 5.0 | 11.4 | 1.0 |
| 21 | 300 | 0.22 | 10.0 | 11.2 | 1.9 |

At an electrode spacing of 3 mm, the electrolyte solution become short circuited to the electrolyte solution from the counter electrode side while it was flowing down. At an electrode spacing in the range of from 5 to 200 mm, satisfactory results were obtained. At an electrode spacing of 300 mm, the surface treatment was satisfactorily achieved although some bubbles were observed on the surface of the carbon fiber strand between the electrodes.

EXAMPLE 22

Figures 5, 6, 7, 8, 9, 10, 11:
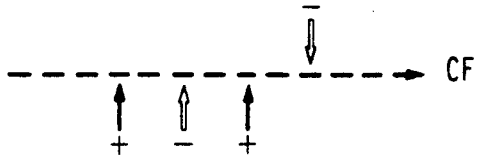
Figures 5, 6, 7, 8, 9, 10, 11, 12:
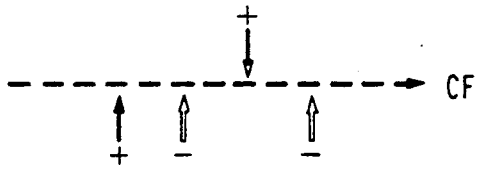
Figures 5, 6, 7, 8, 9, 10, 11, 12, 13:
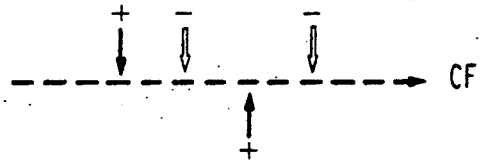
Figures 5, 6, 7, 8, 9, 10, 11, 12, 13, 14:
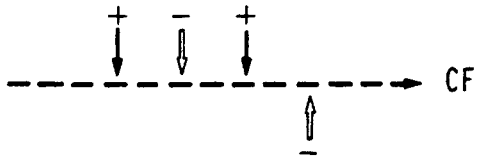
Figures 5, 6, 7, 8, 9, 10, 11, 12, 13, 14, 15:
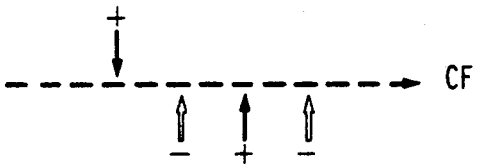
Figures 5, 6, 7, 8, 9, 10, 11, 12, 13, 14, 15, 16:
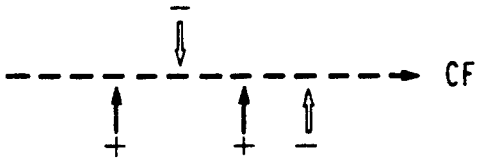
Figure 7:
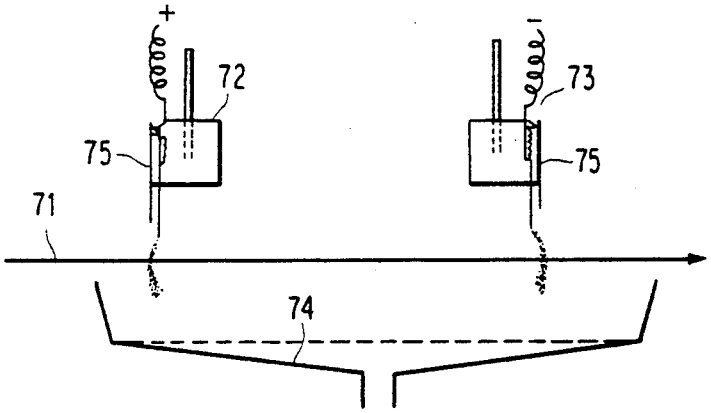
Figure 8:
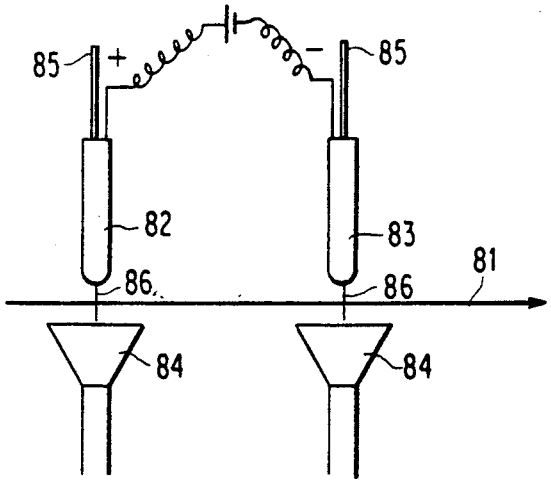
Figure 9:
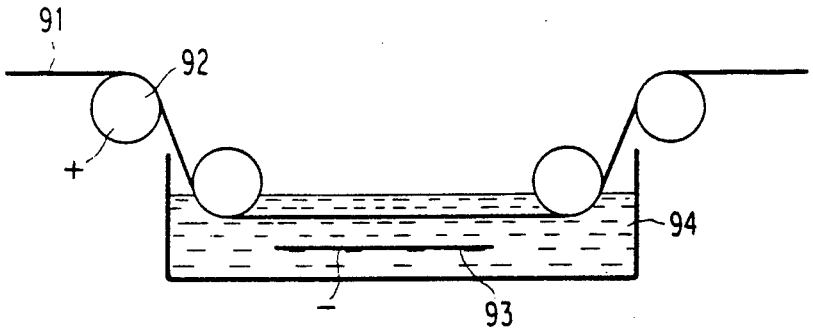
FIG. 9 PRIOR ART
Figure 10:
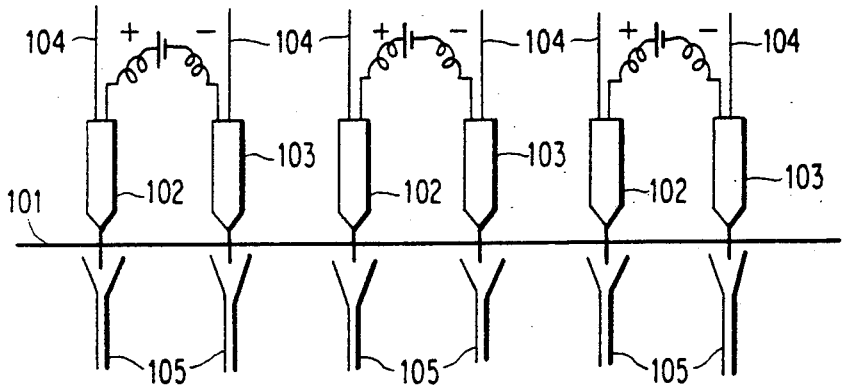
Figure 11:
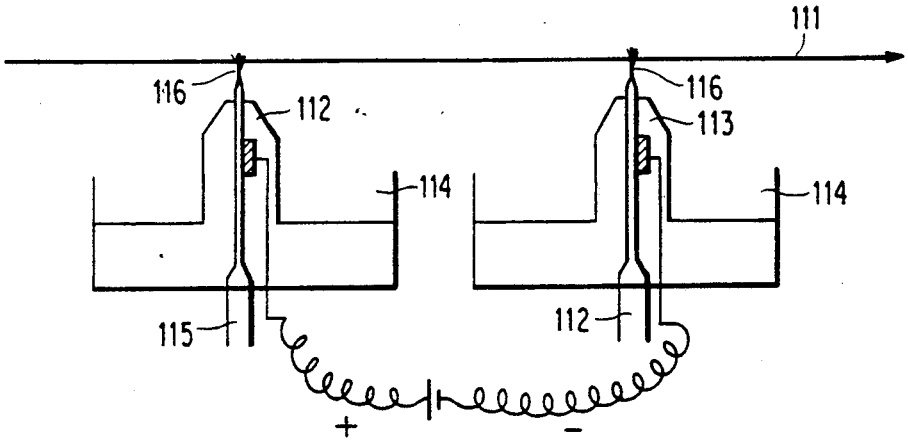

Surface treatments were conducted in the same manner as Example 2 except for changing as follows;

The electrolyte solution was ejected upward using an apparatus as shown in FIG. 11, where numeral 111 denotes a carbon fiber strand; 112, a slit shaped nozzle as the anode: 113, a slit shaped nozzle as the cathode; 114, receiving pans for the electrolyte solution; 115, inlets for the electrolyte solution; and 116, the electrolyte solution. The distance between the carbon fiber strand and the nozzle was 10 mm, and the slit opening was 0.5 mm. The ejection rate of the electrolyte solution was 80 cm/sec. The electrolyte contacted with the carbon fiber strand at a rate of 65 cm/sec. The surface bonded oxygen was 0.21 as the O/C value, and ILSS was 11.0 kgf/mm$^2$, with a variation of 1.0% (n=10) as CV.

EXAMPLES 23 TO 26

Surface treatments were conducted in the same manner as in Example 22 except that the electrode spacing was changed. Table 4 shows the results.

TABLE 4

| Example No. | Electrode spacing (mm) | Surface bonded oxygen (O/C) | ILSS (kgf/mm$^2$) | Treatment time (sec) |
|---|---|---|---|---|
| 23 | 100 | 0.14 | 9.3 | 6 |
| 24 | 150 | 0.17 | 9.8 | 9 |
| 25 | 300 | 0.19 | 10.5 | 18 |
| 26 | 500 | 0.20 | 11.0 | 30 |

From the results, it can be seen that the present invention the processing time length can be reduced to half or less of that of Comparative Example 1 where the time was 30 seconds.

EXAMPLE 27

Onto the starting carbon fiber strands employed in Example 1, an aqueous 8% by weight ammonium sulfate solution was applied using a shower system. The solution impregnated and adhered to the carbon fiber strands was in an amount of 82% by weight based on the weight of the carbon fiber. Subsequently, 100 strands of this carbon fiber were subjected to surface treatment using a apparatus the same as that shown in FIG. 11, as was used in Example 22, except that the apparatus had two pairs of electrode nozzles. The distance between electrodes was 150 mm. An aqueous 8% by weight ammonium sulfate solution was used as the electrolyte solution. Other conditions for the surface treatment were the same as in Example 22.

The treated carbon fiber strands were washed with water, dried at 110° C. and wound up on a bobbin.

The surface-bonded oxygen was determined by ESCA along the length direction of the carbon fiber strands (every 50 cm). The average of the measured values was 0.22, and the CV thereof in the length direction was 5.2%. This variation was less than that of Comparative Example 1. The measured ILSS value of the treated carbon fiber strands was 11.2 kgf/mm$^2$, and the CV thereof was 1.0%, this variation being less than that of Comparative Example 1.

EXAMPLE 28

The surface treatment was conducted in the same manner as in Example 27 except that four electrode terminals were provided (every 25 cm) for each of the nozzles for anodes and cathodes.

The surface bonded oxygen was determined by ESCA along the length direction of the carbon fiber strands (every 50 cm). The average of the measured values was 0.23, and the variation CV thereof in the length direction was 4.1%. This variation was less than that of Comparative Example 1. The measured ILSS value of the treated carbon fiber strands was 11.3 kgf/mm$^2$, and the CV thereof was 0.72%, this variation being less than that of Comparative Example 1.

EXAMPLE 29

The same surface treatments were conducted as in Example 15 except that applying the ammonium sulfate solution was not conducted prior to the surface treatment.

The surface bonded oxygen was determined by ESCA along the length direction of the carbon fiber strands (every 50 cm). The average of the measured values was 0.22, and the CV thereof in the length direction was 6.2%. The variation was less than that of Comparative Example 1. The ILSS value measured of the treated carbon fiber strands was 11.1 kgf/mm$^2$, and the CV thereof was 0.75% the variation being less than that of Comparataive Example 1.

While the invention has been described in detail and with reference to specific embodiments thereof, it will be apparent to one skilled in the art that various changes and modifications can be made therein without departing from the spirit and scope thereof.

What is claimed is:

1. A process for electrolytically treating the surface of a carbon fiber without using a surface treatment bath, comprising forming a flow of an electrolyte solution in the form of a liquid film or column at at least one anode and at at least one cathode which alternate along the direction of the length of the carbon fiber, and passing carbon fiber strands through the flow of the electrolyte solution to apply electric current to the carbon fiber strands.

2. A process for electrolytically treating the surface of a carbon fiber as in claim 1, wherein the carbon fiber strands have applied thereto with water or an electrolyte solution prior to electrolytically treat.

3. A process for electrolytically treating the surface of a carbon fiber as in claim 1, wherein the concentration of the electrolyte is from 0.1 to 20% by weight.

4. A process for electrolytically treating the surface of a carbon fiber as in claim 1, wherein the carbon fiber strand passes through the electrolyte solution where the liquid film or column has a thickness of from 0.025 to 5 mm.

5. A process for electrolytically treating the surface of a carbon fiber as in claim 1, wherein the running direction of the carbon fiber strand is within an angle of from 0° to ±30° from the horizontal direction.

6. A process for electrolytically treating the surface of a carbon fiber strand as in claim 1, wherein the flow of the electrolyte solution is formed by ejecting the electrolyte solution vertically upward or vertically downward or at a direction inclined in an angle of not more than 60° from the vertical so that the flow of the electrolyte solution has a vector component having the same direction as the running direction of the carbon fiber strand.

7. A process for electrolytically treating the surface of a carbon fiber as in claim 1, wherein the treatment is conducted to provide a quantity of electricity of from 10 to 150 coulomb/g of the carbon fiber strand.

8. A process for electrolytically treating the surface of a carbon fiber as in claim 1, wherein the electrolytically treating is conducted under conditions of a terminal voltage of from 5 to 15 volts and an electric current of from 0.5 to 4 amperes/g.

9. A process for electrolytically treating the surface of a carbon fiber as in claim 1, wherein the carbon fiber strand is composed of 100 to 24,000 carbon fiber filaments.

10. A process for electrolytically treating the surface of a carbon fiber as in claim 1, wherein the electrolyte solution is attached to the carbon strand at a rate of from 20 to 500 cm/sec.

11. A process for electrolytically treating the surface of a carbon fiber as in claim 1, wherein the traveling rate of the carbon fiber strand is from 1 to 6 m/min.

* * * * *